United States Patent [19]

Arens et al.

[11] Patent Number: 4,595,031

[45] Date of Patent: Jun. 17, 1986

[54] TUBE SEPARATOR DEVICE

[75] Inventors: Hans Arens, Wertingen; Hans Kern, Vachendorf; Richard Haslberger, Hufschlag, all of Fed. Rep. of Germany

[73] Assignee: Grunbeck Wasseraufbereitung GmbH, Hochstadt, Fed. Rep. of Germany

[21] Appl. No.: 641,956

[22] PCT Filed: Dec. 15, 1983

[86] PCT No.: PCT/EP83/00340

§ 371 Date: Aug. 10, 1984

§ 102(e) Date: Aug. 10, 1984

[87] PCT Pub. No.: WO84/02546

PCT Pub. Date: Jul. 5, 1984

[30] Foreign Application Priority Data

Dec. 21, 1982 [DE] Fed. Rep. of Germany ..... 3247323

[51] Int. Cl.[4] ..... F16K 11/06

[52] U.S. Cl. ..... 137/492.5; 137/625.66; 137/625.68; 251/195; 251/172

[58] Field of Search ..... 137/625.66, 625.68, 137/488, 492, 492.5; 251/195, 328, 196, 172

[56] References Cited

U.S. PATENT DOCUMENTS

| | | | |
|---|---|---|---|
| 2,394,487 | 2/1946 | Rother | 137/625.68 X |
| 2,474,772 | 6/1949 | Ashton | 137/492.5 X |
| 2,705,020 | 3/1955 | Frantz | 137/625.66 |
| 3,006,599 | 10/1961 | Eckert | 251/328 X |
| 3,324,888 | 6/1967 | Henderson | 137/625.68 |
| 3,614,061 | 10/1971 | Fitzpatrick | 251/328 X |
| 4,340,203 | 7/1982 | Donner | 137/625.68 X |
| 4,458,879 | 7/1984 | Jandrasi | 251/328 X |

*Primary Examiner*—Alan Cohan

*Attorney, Agent, or Firm*—Donald Brown; Robert T. Gammons

[57] ABSTRACT

A tube separator (1) is provided comprising a housing (2) with inlet connection (13) and outlet connection (14) and a member (37) being disposed within the housing (2) and slidable between a first and a second end position. The member (37) comprises a channel (49) extending from an entrance opening (55) to an exit opening (56) and an area (40') on which the pressure in the inlet connection may act upon. Furthermore, a spring (46) acts upon the member (37) in a direction opposite to the action of the inlet pressure. The channel (49) forms a connection between the inlet connection (13) and the outlet connection (14) in the first end position of the member (37), and the member (37) separates the inlet connection (13) from the outlet connection (14) in the second end position of the member (37). The entrance opening (55) and the exit opening (56) each comprise a straight secant, and their respective secants being parallel to each other. Since the member (37) is displaced in a direction parallel to the secants (95, 96) the volume ventilated when the member (37) is displaced can be kept as small as possible.

8 Claims, 3 Drawing Figures

85'
85
83
82
81
72
99
88
80
77
76
1
61
78
69
40'
73
89
4
3
43
7
75
44
68
71
74
39
40'
79
40
98
86
67
35
87
65
66
2
48
70
38
57
58
11
20'
24
26
10
50
55
56
18
34
90
49
19'
29
30
91
12
97
23
51
52
100
25
62
92
31
59
64
93
13
17
19
27
28
32
20
16
14
15
10
21
22
11
45
53
47
60
54
41
42
95
37
96
36
46

8
5
6
94
9

TUBE SEPARATOR DEVICE

The invention refers to a tube separator comprising a housing having an inlet connection and an outlet connection, and a member being disposed within the housing and slidable between a first and a second end position and which comprises a channel extending through the member from an entrance opening to an exit opening and an area on which the pressure in the inlet connection may act upon, and a spring acting upon the member in a direction opposite to the action of the inlet pressure, whereby the channel forms a connection between the inlet and the outlet connection in the first end position and the member separates the inlet connection from the outlet connection in the second end position, the entrance opening and the exit opening each comprising a respective straight secant, the respective secants being parallel to each other.

A tube separator of this kind is known from the DE-AS 2759174. In this known tube separator the fluid passes in longitudinal direction of the member in the first position thereof, in which it forms a connection between the inlet connection and the outlet connection. The movement into the second position, in which the inlet connection is separated from the outlet connection, is performed by displacing the member in longitudinal direction thereof. In this second position the one side of the channel opening is closed, whereas the other side is connected to the environment via a drain conduit. Hence this solution raises the problem that in the second end position of the member the channel is ventilated and after switching into the first position the enclosed air is pressed into the water line. This problem is aggravated by the fact that the passage or channel in the member has a relatively large volume due to the principle of longitudinal displacement of the member, which leads to a relatively large volume of the enclosed air. Furthermore, in this known solution the number of sealing elements being in engagement between the displaceable member and the housing varies according to the position of the member, which may cause a sticking of the member in an intermediate position due to varying friction conditions along the way of displacement.

It is the object of the invention to provide an improved tube separator. In particular the air input into the conduit system shall be kept as small as possible. Furthermore, a safe function of the tube separator shall be ascertained without there being a possibility of sticking of the tube separator.

This object is achieved by a tube separator of the above mentioned kind, which according to the invention is characterized in that the channel extends transversely through the member and the member is displaced in a direction transversely to the axis of the channel and the axis of inlet and outlet connection.

Preferably the member is designed as flat slide valve, wherein the seal between the housing and the member or the channel within the member, respectively, is preferably obtained by flat ceramic gaskets. In order to keep the displacement of the member as small as possible the entrance and exit openings may have a smaller dimension in the direction of displacement than for example transversely thereto.

To improve the reaction of the tube separator a control valve may be provided having a first position in which it allows the area of the member, on which the pressure may act upon and which is preferably designed as flange or piston, to be acted upon by the fluid pressure in the inlet connection, and changing-over into a second position, if this pressure falls below a preadjusted value, and allowing the area of the member to be acted upon by a lower pressure, preferably environmental pressure, in this second position. The fluid volume to be removed by the displacement of the member may be expelled via a channel provided within the member itself and through a drain opening at the housing. Preferably the control valve is designed adjustable such that the change-over pressure of the tube separator is adjustable to e.g. a varying building height.

Further features and advantages will stand out from the description of embodiments of the invention in connection with the Figures. In the Figures.

Figure 1:
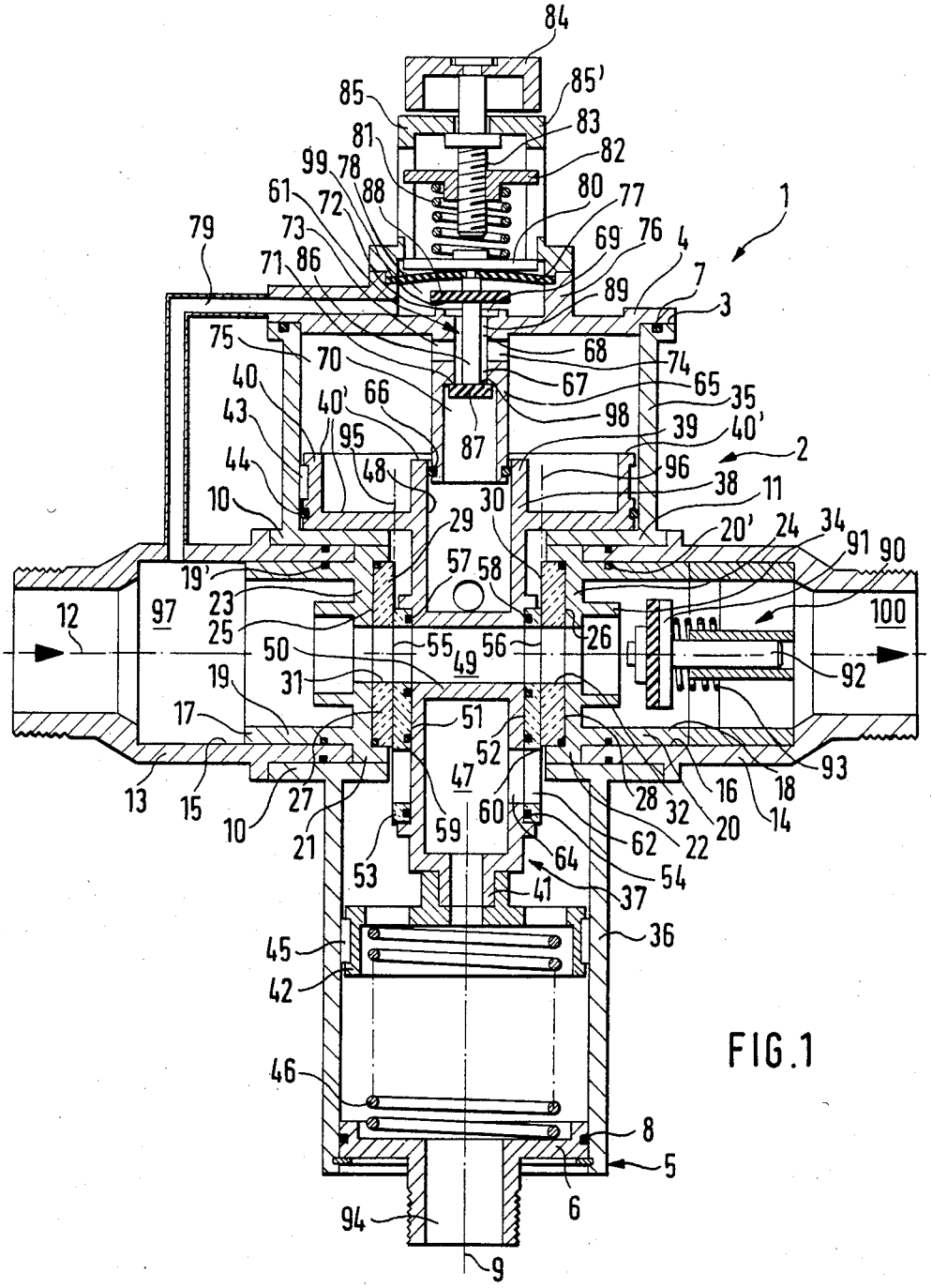
FIG. 1 is a sectional view of a first embodiment of the invention in flow-through position.

The tube separator 1 shown in FIG. 1 comprises a housing 2 which is substantially formed as a hollow cylinder having the upper face 3 tightly closed by means of a cap 4 and the lower face 5 tightly closed by means of a cap 6 with interposed seals 7 and 8, respectively. In the intermediate region between the faces 3, 5 the housing comprises receiving sections 10, 11 being disposed on diametrically opposite sides with respect to the longitudinal axis 9 of the housing and being shaped as cylindrical bushings having a common axis 12 intersecting the housing axis 9 at a right angle. An inlet connection 13 and an outlet connection 14 shaped as connecting sockets are tightly inserted and secured in the respective receiving sections 10, 11. Respective inserts 17, 18 being designed for receiving gaskets are inserted into the inlet connection 13 and the outlet connection 14 from the interior of the housing. The connection between inlet connection and insert 17 is designed such that the insert 17 may be displaced towards the outlet but not towards the inlet side. The connection between the outlet connection 14 and insert 18 is inversely designed such that the insert 18 may be displaced towards the inlet side, but not towards the outlet side. To this end the inlet connection 13 and the outlet connection 14 each comprise hollow cylindrical regions 15, 16 being coaxial with the axis 12. The inserts 17, 18 each comprise outer cylindrical guide sections 19, 20 having an outside diameter selected such that they are slidably received within the respective cylindrical section 15, 16. Seals 19', 20' are provided between the cylindrical walls. The guide members 19, 20 comprise radially outwardly projecting edges 21, 22 at their front side facing the interior of the housing, the edges abutting against the respective front sides of the cylindrical regions 15, 16. The inserts 17, 18 further comprise a mounting designed as cylinder bottoms 23, 24 for receiving gaskets 27, 28 at their ends facing the interior of the housing. At their sides facing each other the cylinder bottoms 23, 24 have recesses 25, 26 in which the gaskets, which according to the invention are formed as ceramic washers 27, 28, are inserted such that their opposing planes 29, 30 are disposed in a distance parallel to each other. An inlet opening 31 and an outlet opening 32, both openings being coaxial with each other, extend through the cylinder bottoms 23, 24 and the ceramic washers 27, 28, respectively. It is obtained in this manner that the gaskets 27, 28 are displaceable towards the interior of the housing, but not towards the inlet or the outlet, respectively.

Furthermore the housing 2 comprises a first cylindrical section 35 between the receiving sections 10, 11 and the upper face 3 and a second cylindrical section 26 between the receiving sections 10, 11 and the lower face 5.

Within the housing 2 there is provided a member 37 serving as a shut-off slide valve and being slidable along the axis 9. The member 37 consists substantially of a piston rod 38, a piston 40 disposed at a first end 39 of the piston rod 38 and connected thereto and an abutment 42 disposed at the second end 41 of the piston rod 38 and connected thereto. The piston rod 38 is designed as a hollow tube having a first channel 47 extending in longitudinal direction through the rod from the upper first end to the lower second end and having a cylindrical channel section 48 adjacent to the upper end 39. The longitudinal axis of the piston rod 38 coincides with the housing axis 9. A bore designed as a second channel 49 separated from the first channel 47 by means of the wall 50 extends transversely through the piston rod in the middle region thereof between the first end 39 and the second end 41. The length of the piston rod 38 is selected such and the piston rod is arranged such that the first end 39 is disposed within the first section 35 and the second end 41 is disposed within the second section 37 of the housing 2.

The piston 40 is tightly supported in a manner to be slidable between an upper first end position, in which the piston 40 abuts against the cap 4, and a lower second end position, in which the piston 40 abuts against the bushing-shaped receiving sections 10, 11, by means of guiding elements 43 and seals 44 within the first section 35.

The abutment 42 is designed as an abutment for a spring 46 engaging on the cap 6 and is slidably supported within the second section 36 by means of lateral guide elements 45. Venting openings are provided in the abutment 42 for connecting those parts of the second section 36 which are separated by the abutment.

The position of the second channel 49 is dertermined such that this second channel 49 is aligned with the inlet opening 31 and the outlet opening 32 if the member 37 is in the lower first end position thereof. Mountings 51, 52 for receiving gaskets 53, 54, which according to the invention are designed as ceramic washers, are provided at the inlet side of the channel 49 facing the inlet opening and on the outlet side of the channel 49 facing the outlet opening 32 at the piston rod 38 in a manner to be opposed to each other. The mountings surround the ceramic washers such that a displacement thereof in displacement direction of the member 37 is prevented. The ceramic washers 53, 54 each comprise holes 55, 56 being adapted to the cross-section of the channel 49 and being aligned therewith. Circumferential seals 57, 58 surrounding the channel 49 are provided between the piston rod 38 and the ceramic washers 53, 54. The holes 55, 56 form the inlet opening and the outlet opening, respectively, of the channel 49 at the outer surfaces 59, 60 of the ceramic washers 53, 54. The surfaces 59, 60 are disposed parallel to each other and the distance between them is selected to be at most the distance between the two ceramic washers 27, 28 if the edges 21, 22 of the inserts 17, 18 abut against the inlet connection or outlet connection, respectively. The respective ceramic washer 27, 53 and 28, 54 form a cooperating pair of flat gaskets.

Below the channel 49 the ceramic washer 54 has a further hole 62 having the same shape as the holes 56. The holes 56 and 62 are offset by a distance from each other corresponding to the displacement of the member 37 from the first to the second position thereof. At the place of the hole 62 the piston rod 38 has a hole 64 being aligned with the hole 62 at the side facing the ceramic washer 54.

The inlet side referenced as 97 is connectable with the cylinder space 75 via a branch conduit 79 and a valve 61. In order to form the valve the cap 4 has a cylindrical extension 65 projecting downwardly coaxially with the axis 9 and having a diameter which is slightly smaller than the inner diameter of the channel section 48, and which carries a circumferential seal 66 at the lower end thereof. The length of the extension 65 is selected such that it projects into the channel section 48 and tightly closes the upper side of the first channel 47 by means of the circumferential seal 66 in any position of the member 37. A channel 67 having an intermediate section 68 and two end sections 69, 70 having a greater diameter than the intermediate section 68 extends in a longitudinal direction through the extension 65 and the cap 4. The transition from the intermediate section 38 to the lower end section 70 forms a valve seat 71, and a further valve seat 72 is formed by the end surface of the outside of cap 4 adjacent to the upper end section 69. The diameter of the valve seat 72 is larger than that of the valve seat 71. Radial bores 73, 74 are provided in the extension 65 in a distance below the cap 4 which is selected as small as possible. The bores 73, 74 connect the cylinder space 75, which is defined by cap 4, extension 65, piston 40 and first section 35, with the intermediate section 68 of the channel 67.

Means for adjusting the change-over point of the valve 61 are provided at the cap 4. An annular extension 76 having its free end plane closed by a diaphragm 77 is provided at the side of the cap opposing the extension 65 and coaxially thereto. The diaphragm 77, the extension 76 as well as the cap 4 form a space 78 which is connected with the inlet connection via the control or branch conduit 79 opening into the space 78 at the side thereof. A plate 80 supported by a second plate 82 via a compression spring 81 is disposed at the side of the diaphragm 77 opposed to the space 78. The plate 82 is in engagement with an adjustment screw 83 which may be turned by means of a rotary knob 84. The adjustment screw 83 is supported by a housing top 85 having a scale 85' thereon which allows to read the initial stress of the spring 81 by means of the position of the rotary knob 84.

A valve rod 86 extending into the channel 67 in the direction thereof is mounted to the diaphragm 77 on the side thereof facing the space 78. The valve rod 86 carries a first valve body 87 at its free end and a second valve body 88 between the first body 87 and the diaphragm 77. The first valve body 87 cooperates with the valve seat 71 and the second valve body 88 with the valve seat 72. The distance between the valve bodies 87 and 88 is slightly larger than the sum of the length of the intermediate section 68 and the upper end section 69 such that a distance is provided between the valve seat 72 and valve body 88 in the position of the valve bodies 87, 88 shown in FIG. 1. The diameter of the valve rod 86 is smaller than the inner diameter of the intermediate section 68 such that an annular gap 89 is formed between the valve rod 86 and the interior wall of the intermediate section 68.

A check valve 90 comprising a valve disc 91 and a guide rod 92 extending perpendicular therefrom is disposed in the outlet connection 14. The guide rod 92 is supported by a sleeve connected with the outlet connection in a manner to be slidable in direction of axis 12 and is biased towards a ring 34 formed as a valve seat at the wall of the cylinder bottom 24 facing the outlet by means of a compression spring 93. The height of the ring 34 is selected to be as small as possible, preferably in the order of a few millimeters, such that the distance of the valve seat from the sealing area 60 is as small as possible. Finally, an outlet opening 94 for connection to a drain is provided in the lower cap 6.

Figure 3:
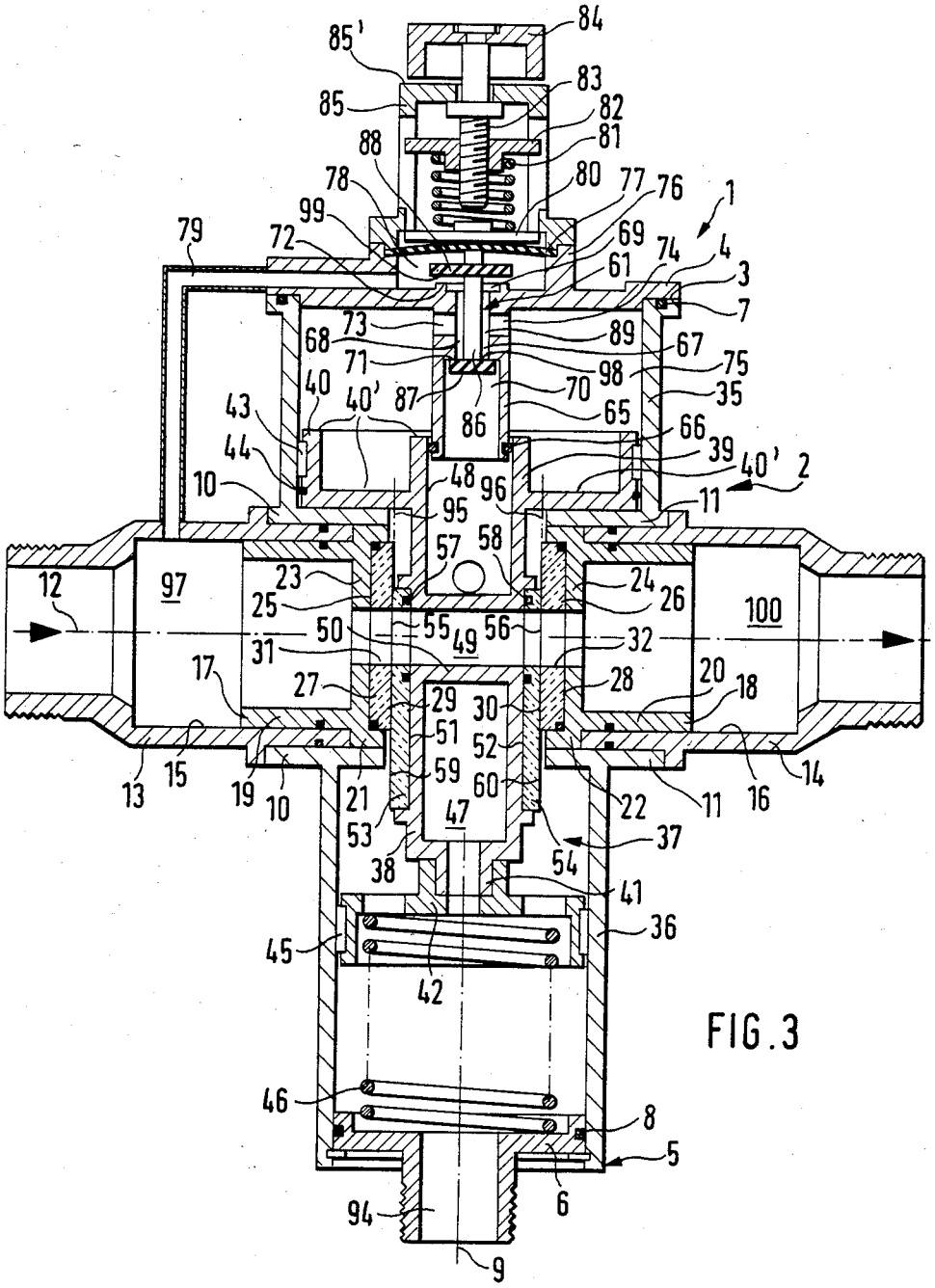
FIG. 3 is a sectional view of a second embodiment of the invention in flow-through position.

The embodiment shown in FIG. 3 differs from the embodiment of FIG. 1 merely in that the check valve 90 is not provided and hence also the ring 34 may be eliminated. Furthermore, also the hole 62 in the ceramic washer 54 and the hole 64 in member 37 is not provided. The remaining similar parts are referenced to with the identical reference numerals.

Figure 2:
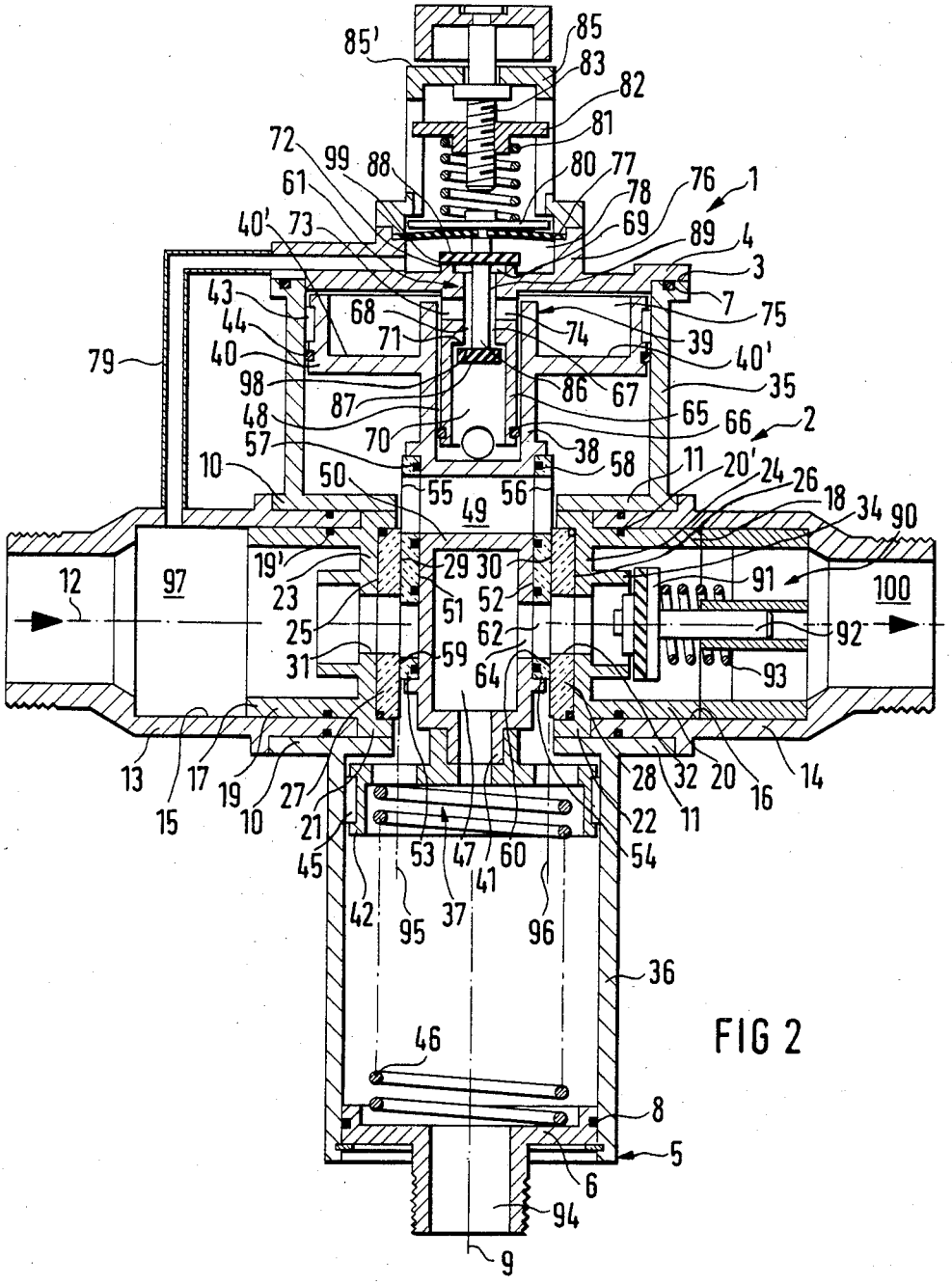
FIG. 2 is a sectional view of the first embodiment of the invention in stop position.

The operation of the apparatus will be described in connection with FIGS. 1 and 2. FIG. 2 shows the same embodiment of the tube separator as FIG. 1, but with the member 37 in the second end position, whereby the tube separator is in separating position.

The flow-through position shown in FIG. 1 prevails as long as the inlet pressure existing on the inlet side 97 and within the inlet connection 13, respectively, does not drop below a determined adjusted value. This pressure is communicated to the space 78 via the branch conduit 79 and acts upon the diaphragm 77 as well as upon a first area 98 of the first valve body 87 via the gap between the valve body 88 and the valve seat 74 and the annular gap 89. The net force acting upon the spring 81 via the diaphragm 77 results from the difference of the force acting upon the diaphragm area 77 and the force acting upon the first area 98. If the spring 81 is biased such that this net force is sufficient to hold the valve in its first position shown in FIG. 1, in which the first valve body 87 abuts against the valve seat 71, then the pressure within space 78 is communicated to the cylinder space 75 via the gap between the second valve body 88 and the valve seat 72 and via the annular gap 89 and the bores 73, 74. Hence in this case the pressure within the cylinder space 75 corresponds about to the pressure on the inlet side 97, and the piston 40 or the area 40' of the piston 40 which may be acted upon by the pressure and has a dimension normal to the displacement direction of the member 37, is acted upon by a pressure corresponding about to the inlet pressure. Thus the piston 40 as well as the complete member 37 is forced or held, respectively, against the force of spring 46 in the first end position shown in FIG. 1, in which the channel 49 is aligned with the inlet opening 31 and the outlet opening 32. The inlet pressure acts upon the check valve 90 through the passage formed by the channel 49 and lifts the check valve 90 off from ring 34 such that the flow through the tube separator is possible.

If the inlet pressure decreases a point will be reached where the force acted upon the spring 81 by means of the diphragm 77 is no more sufficient to force the diaphragm 77 against the force of spring 81 upwardly and thus the first valve body 87 in abutment with the valve seat 71. Rather the spring 81 will urge the diaphragm downwardly and hence the second valve body 88 onto the valve seat 72. Thus the connection of the inlet side with the cylinder space 75 is interrupted. At the same time the first valve element 87 is lifted off from valve seat 71 by the movement of the valve rod 86, whereby a connection of the cylinder space 75 with the outlet opening 94 is created via the bores 73, 74, the annular gap 89, the end section 70 of channel 67 and the channel 47. Since the pressure at the outlet opening is lower, for instance the environmental pressure, the pressure within the cylinder space 75 drops from the inlet pressure to e.g. the environmental pressure, when the valve formed by the valve elements 87, 88 is changed over. As a result thereof the spring 46 moves the member 37 upwardly into a second end position thereof. The volume displaced thereby by the piston 40 is expelled via the bores 73, 74, the channel 67 and the channel 47 to the outlet opening 94.

The upper end position is shown in FIG. 2. By the upward movement of the member 37 the channel 49 is displaced with respect to the inlet opening 31 and the outlet opening 32 to such an extent that there is no longer a connection between the inlet opening 31, channel 49 and outlet opening 32. During the movement of the member 37 and in the second end position thereof the sealing is performed by means of the both pairs of flat ceramic gaskets 27, 53 and 28, 54. As shown in FIG. 2, in the upper end position the holes 62, 64 are aligned with the outlet opening 32 and hence the latter is connected with the outlet opening 94 via the channel 47 such that the pressure at the upstream side of check valve 90 drops to the pressure within outlet opening 94 and hence the check valve 90 is urged towards the ring 34 by means of the spring 93 and shuts off the downstream side from the channel 47.

If the inlet pressure rises again and a predetermined change-over pressure is exceeded, the diaphragm 77 is moved upwardly, the valve body 88 is lifted off from valve seat 72 and the valve body 87 is urged against the valve seat 71. Hence the inlet side 97 is again connected with the cylinder space 75 and the rising pressure within the cylinder space 75 will force the member 37 downwardly into its flow-through position.

Due to the fact that the diameter of the intermediate section 68 is smaller than that of the end section 69 of the channel 67, the first area 68 exposed to the inlet pressure in the first position of the valve 61 formed by the valve bodies 87 and 88 is smaller than the second area 99 exposed to the inlet pressure in the second position. Hence, assuming equal inlet pressure, in the first position the force acting in opposite direction to the force acting on the diaphragm 77 is smaller than in the second position. Thus the net force acting upon the compression spring 81 decreases when the valve is changed over from the first position into the second position and a higher inlet pressure is required for changing back into the first position. In other words the change-over pressure required for changing over the tube separator from the flow-through position into the shut-off position is lower than the change-over pressure required for changing over from the shut-off position into the flow-through position, assuming equal biasing of the spring 81. This switching hysteresis obtained thereby prevents an immediate changing back or flutter of the tube separator for slight pressure fluctuations. The respective desired change-over pressure can be adjusted by adjusting the initial stress of the spring 81 by means of the rotary knob 84, whereby the initial stress may be read from the scale 85'.

When moving into the shut-off position the channel 49 is displaced upwardly and the channel section between the check valve 90 and the sealing area 60 is ventilated. Since the channel 49 must only have a length which is prescribed for the distance between the source side and the drain side, i.e. the distance between the sealing area 59 and the sealing area 60, the amount of introduced air is small even in the case in which the channel 49 is ventilated. The ventilation of the channel 49 can further be prevented by extending the ceramic washers 27, 28 upwardly to such an extent that the end planes of the channel 49 are defined by the ceramic washers 27, 28 also in the shut-off position. Finally, the ventilation of the space between the sealing area 60 and the check valve 90 is prevented in the apparatus shown in FIG. 3 in that manner, that the space is not connected with the outlet opening 94 due to the missing holes 62, 64, but the side thereof facing the member is sealed by the flat ceramic gasket 54 in the shut-off position. Hence the downstream side 100 is separated from the outlet opening 94 by means of the member 37 itself and the check valve is no longer necessary.

The mutually sealing ceramic washers 27, 53 and 28, 54 exhibit the property that the force required for a mutual displacement is to a large extent independent of the contact pressure forcing both washers into contact with each other. It is only necessary to assure that the distance of the respective washer pairs does not exceed a certain amount. According to the invention this is obtained by forming the inserts 17, 18 supporting the outer washers 27, 28 slidable within the housing 2 or the inlet connection 13 or outlet connection 14, respectively, in the direction towards the respective sealing areas 59, 60 and away therefrom, and providing the inserts 17, 18 with a bottom exposed to the inlet or outlet pressure, respectively. Hence the pressure of the medium forces the inserts 17, 18 and thus the ceramic washers 27, 28 against the ceramic washers 53 or 54, respectively, whereby an exact mutual fitting of the pairs of flat gaskets can be achieved independent of manufacturing tolerances. The friction force encountered during the displacement does not vary, because only the two pairs of flat gaskets are in engagement over the whole displacement of the member 37, whereby a jerkless and secure displacement of the member 37 is ascertained.

In the embodiment described above the inlet opening 55 and the outlet opening 56 of the channel 49 are disposed in parallel planes. However, this is merely a preferable embodiment of the inventive tube separator. Basically, it is only necessary for the inlet opening 55 and the outlet opening 56 to have a respective straight secant, and for both secants to be parallel to each other, whereby the displacement direction of the member 37 is parallel to the secants. These secants are defined such that they connect two points of the border line of inlet and outlet opening. As an example two such secants 95, 96 are marked in FIG. 1 with dotted line. Generally it can be stated that the mentioned condition is met if and when the inlet opening and the outlet opening are formed on the generated surfaces of cylinders having parallel axes extending in displacement direction of the member 37.

In order to keep the displacement of the member 37 as small as possible, given a predetermined cross-section of the channel 49, the cross-section of the channel 49 as well as the inlet opening 55 and the outlet opening 56 may be formed with a smaller dimension in direction of the secants 95, 96 than in direction deviating therefrom. As an example the cross-section of the channel 49 as well as the inlet and outlet openings may be of oval shape, whereby the smaller semi-axis extends in the direction of displacement of member 37 or in direction of the secants 95, 96, respectively.

We claim:

1. A tube separator comprising a housing having an inlet, an outlet and a drain opening, a slide valve member having a channel extending along an axis from said inlet opening to said outlet opening through said slide member and an area to be acted upon by the inlet fluid pressure.

a spring member acting on said slide member in a direction opposite to said fluid pressure.

said slide valve member being slidably supported within said housing in a direction transversely to said axis of said channel and to the axis of said inlet and said outlet between a first end position in which said channel forms a connection between said inlet and said outlet and a second end position in which said slide valve member separates said inlet from said outlet, said slide valve member comprising respective flat ceramic gasket elements disposed at both ends of said channel and being in fluid-tight engagement with a respective flat gasket element connected with said housing, said respective flat gasket elements being each connected to a part which is supported within said housing or said inlet and outlet, respectively, to be slidable in a direction which is substantially perpendicular to the sealing area of the flat gasket elements such that the part is urged onto the respective flat gasket element by means of the fluid pressure in the inlet and outlet, respectively.

2. The tube separator of claim 1, wherein the inlet opening and the outlet opening each have a smaller dimension in the direction of displacement than in another direction.

3. The tube separator of claim 1, wherein a piston cylinder means is provided having an effective piston area formed by the area to be acted upon, and that a branch conduit connecting the inlet side with the cylinder space is provided.

4. The tube separator of claim 3, wherein a valve connecting the branch conduit with the cylinder space in a first position thereof and connecting the cylinder space with a drain channel in the second position thereof is provided between the branch conduit and the cylinder space.

5. The tube separator of claim 4, wherein the valve changes over in dependence on the pressure on the inlet side and that the changeover point is adjustable.

6. The tube separator of claim 3, wherein the valve comprises a first and a second area which is connected with the valve body and on which in the first and second valve position, respectively, the medium to be supplied via the branch conduit may act such that there acts a force component for changing over into the second position, and that the first area is smaller than the second area.

7. The tube separator of claim 1, wherein a check valve closing or opening, respectively, the inlet of the downstream side to be connected with the channel is provided at the downstream side of the housing.

8. A tube separator comprising a housing having an inlet, an outlet and a drain opening, a cylinder space connected with said inlet, a valve member slidably supported within said housing for connecting said inlet with said outlet in a first sliding position and for separating said outlet from said inlet and connecting said outlet with said drain opening in a second sliding position, said valve member comprising a tubular member having a first channel extending lengthwise through said member for forming a connection between said cylinder space and said drain in said second sliding position, a second channel being separated from said first channel and extending transversely through said valve member for forming a connection between said inlet and said outlet in said first sliding position, an opening ending in said firt channel and being offset from said second channel in sliding direction of said slide member for forming a connection between said outlet and said first channel in said second sliding position, and a flange member connected with said tubular member and being disposed within said cylinder space, whereby said first channel forms a drain for any fluid displaced by said flange member if said valve member slides from said first sliding position to said second sliding position and as well serves as a drain for any fluid flowing from said outlet through said opening to said drain opening.

* * * * *